US006752600B2

(12) United States Patent
Worthington

(10) Patent No.: US 6,752,600 B2
(45) Date of Patent: Jun. 22, 2004

(54) FLUID SYSTEM

(75) Inventor: Wayne R. Worthington, Waterloo, IA (US)

(73) Assignee: Wayne Engineering Corporation, Cedar Falls, IA (US)

( * ) Notice: Subject to any disclaimer, the term of this patent is extended or adjusted under 35 U.S.C. 154(b) by 1 day.

(21) Appl. No.: 10/126,213

(22) Filed: Apr. 19, 2002

(65) Prior Publication Data

US 2003/0198559 A1 Oct. 23, 2003

(51) Int. Cl.[7] ..... F04B 49/00
(52) U.S. Cl. ..... 417/286; 417/2; 60/452
(58) Field of Search ..... 417/286, 287, 417/288, 293, 2, 42; 60/422, 431, 463, 486, 447, 452

(56) References Cited

U.S. PATENT DOCUMENTS 3,540,218 A * 11/1970 Finn, Jr. ..... 60/52
3,935,707 A * 2/1976 Murphy et al. ..... 60/444
4,002,027 A * 1/1977 Eley et al. ..... 60/430
4,164,119 A 8/1979 Parquet ..... 60/428
4,199,943 A * 4/1980 Hunt ..... 60/430
4,381,904 A 5/1983 Kyte et al. ..... 417/287
5,489,005 A * 2/1996 Marcott et al. ..... 180/134
5,883,799 A * 3/1999 Bladow et al. ..... 364/138
6,260,647 B1 * 7/2001 Calamari et al. ..... 180/179
6,314,727 B1 * 11/2001 Prabhu et al. ..... 60/431
6,422,121 B1 * 7/2002 Wysong ..... 91/356

* cited by examiner

*Primary Examiner*—Justine R. Yu
*Assistant Examiner*—Han L Liu
(74) *Attorney, Agent, or Firm*—Husch & Eppenberger, LLC; Robert E. Muir; Robert C. Haldiman

(57) ABSTRACT

A fluid system for plural motor driven pumps is disclosed. The fluid system includes a hydraulic motor, a fluid reservoir, and a plurality of fixed displacement pumps. A control valve selectively directs flow of fluid to either a reservoir or the hydraulic motor. A control system responsive to an external condition and an internal condition generates a signal for each condition. The control valve is operated by the signals. The internal signal may be generated by an internal pressure monitoring device.

13 Claims, 2 Drawing Sheets

FLUID SYSTEM

FIELD OF THE INVENTION

The invention relates generally to the field of hydraulics on refuse trucks and more particularly to a hydraulic pump unloading or control system on refuse trucks. The system may have a plurality of fixed displacement pumps driven by a single engine and a valve incorporating electrical control circuitry for selectively activating diverse combinations of pumps in response to drive conditions such as engine speed, the circuit being activated, and the pump pressure during activation.

BACKGROUND OF THE INVENTION

Many hydraulic circuit configurations and combinations of valves have been devised with the purpose of modifying the hydraulic pressure or flow supply based on the power requirements of the system or based on the availability of power to drive the system. A majority of such systems use variable displacement pumps that are typically more expensive and complex than standard fixed displacement pumps. However, there are some systems that use fixed displacement pumps in combination with hydraulic control circuitry to accommodate variability in hydraulic pressure and flow supply. For example, U.S. Pat. No. 4,164,119 provides an unloading system with fixed displacement pumps that prevents stalling of the drive engine in response to flow or pressure conditions in the hydraulic line. The multiple fixed displacement pump system of U.S. Pat. No. 4,002,027 modifies flow supply by combining two pump outputs when necessary based on pressure or flow conditions in the hydraulic lines with the aim of eliminating the need for high engine and pump speed solely to supply flow requirements. Yet another system in U.S. Pat. No. 4,381,904 provides a circuit with numerous fixed displacement pumps selectively activated in response to pressure and flow conditions in the hydraulic line as a means of providing variable pressure and flow requirements.

The prior art in hydraulic pump unloading or control systems with a plurality of fixed displacement pumps has heretofore used pressure and/or flow response means to drive the logic of the variable flow and pressure supply. Pressure and flow responsive mechanisms in the hydraulic circuits provided a means of indirectly measuring and reacting to the power supply of the driving means of the hydraulic system. However, the addition of complex and/or numerous valving and hydraulic mechanisms to the circuits not only increases the cost of the system, but also can make precise and accurate control of the pressure and flow supply more difficult to manage and predict.

Some of the pump control systems have been adapted specifically to tractors or refuse equipment where fluctuating hydraulic needs are common and are further complicated because the drive speed of the pump(s) varies with the speed of the tractor or refuse truck. Often the demands on the hydraulic system are greatest when the engine speed is at its lowest because the tractor or refuse truck is at a standstill. In refuse trucks for example, it has been common to have a single fixed displacement pump to provide for the needs of the hydraulically operated packer. The packer requires a certain level of flow to function adequately and the pump must be run at high speeds to provide that flow. This requires the operator to speed up the engine of the refuse truck to drive the pump at the required speed even if the truck is at a standstill and the horsepower requirements are low. This is normally the case on a front or side loading truck where the refuse is pushed into an empty body. Pressures are low so required horsepower is also low. Some refuse trucks are equipped with variable displacement pumps to handle the changing needs of the hydraulic system and adapt to varying engine speed, but typically there are only a few operating modes and the capabilities of nearly infinite adjustment is deemed too expensive and unnecessary. Further, these types of systems require a more sophisticated mechanic to be able to troubleshoot and repair them. For example, packers and loaders are used on a refuse truck when the truck is stopped and the packer is used when the truck is moving between stops, but there are not commonly many other distinctive modes of operation. A few different operating modes of the hydraulic system would address all of the requirements for variability.

Another variable flow requirement typical of refuse packers is introduced with the inclusion of the telescopic cylinders that are used to drive the packer on front and side loader type refuse trucks. As the packer compresses the refuse, the telescopic cylinder extends and the demand for fluid flow is high due to the relatively large bore and considerable length of the telescopic cylinders used in this application. In addition, the pressure demand is at a high particularly at the end of the packing cycle when the refuse body is almost full. In this condition, the telescopic cylinders extend so as to sufficiently compress or pack the refuse. Even when the body is full, this only happens at the very end of the packing cycle. The first part of the cycle is used to sweep the material toward the body. This uses very little pressure. As the packer returns to its starting position the telescopic cylinder retracts and only a small fraction of the extension flow rate is needed to provide acceptable retracting rates given that the hydraulic fluid now acts on the rod end of the cylinder where most of the volume is occupied by the telescopic rods. The volume ratio for equal extension and retracting speeds can be 4:1 or higher in typical telescopic cylinders. In a typical refuse truck a single fixed displacement pump is usually selected that meets the flow rate requirements of the packer cylinder(s) in the extension cycle. As the same high flow rate is applied to retract the telescopic cylinder, the system wants the retracting speed to be 4 times (for a 4:1 volume ratio) the extension speed. This creates a problem in that it is difficult to evacuate all the fluid from the base end of the cylinder fast enough to allow such high-speed cylinder retraction. The large flows cannot be accommodated by standard lines and valving. What typically happens is that the flow out of the base end of the cylinder is therefore limited by these components. The flow going into the rod end side of the telescopic cylinder is therefore also limited. The excess flow must go over the relief valve. This flow goes over the relief valve at system pressure. Often the volume of fluid that passes over the relief valve is considerable. This generates a significant amount of heat. Common attempts to solve the problem include the inclusion of large and expensive dump valves at the base end of the cylinder, but even with those additions it is frequently not practical to allow such high-speed retraction. Many refuse trucks also include automated loading systems and constantly running packers. These also increase the overheating problem in a hydraulic circuit. The constant heat generation as the packer cylinders retract becomes an even more significant problem.

The present invention is directed to overcoming one or more of the problems set forth above.

BRIEF SUMMARY OF THE INVENTION

In accordance with one aspect of the present invention there is provided an improved pump control system for use on refuse trucks, wherein a plurality of fixed displacement pumps are selectively turned "on" or "off" in response to an external signal.

Another aspect provides an improved pump control system that uses an engine speed measuring device.

Still another aspect provides an improved pump control system, wherein a plurality of fixed displacement pumps are selectively turned "on" or "off" in response to the combination of an external signal and an internal signal.

Yet another aspect provides an improved pump control system that uses an engine speed measuring device and a device to measure system pressure.

In accordance with the present invention there is provided a fluid system for use on a refuse truck and including a hydraulic motor which may be a hydraulic ram; a fluid reservoir; a plurality of fixed displacement pumps; drive means operatively connected to the fixed displacement pumps for driving the same; a control valve for selectively directing a flow of fluid to either the reservoir or the hydraulic motor; and a control system having means for determining an external condition and generating a corresponding signal, and means responsive to the signal for switching the control valve.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

Figure 1:
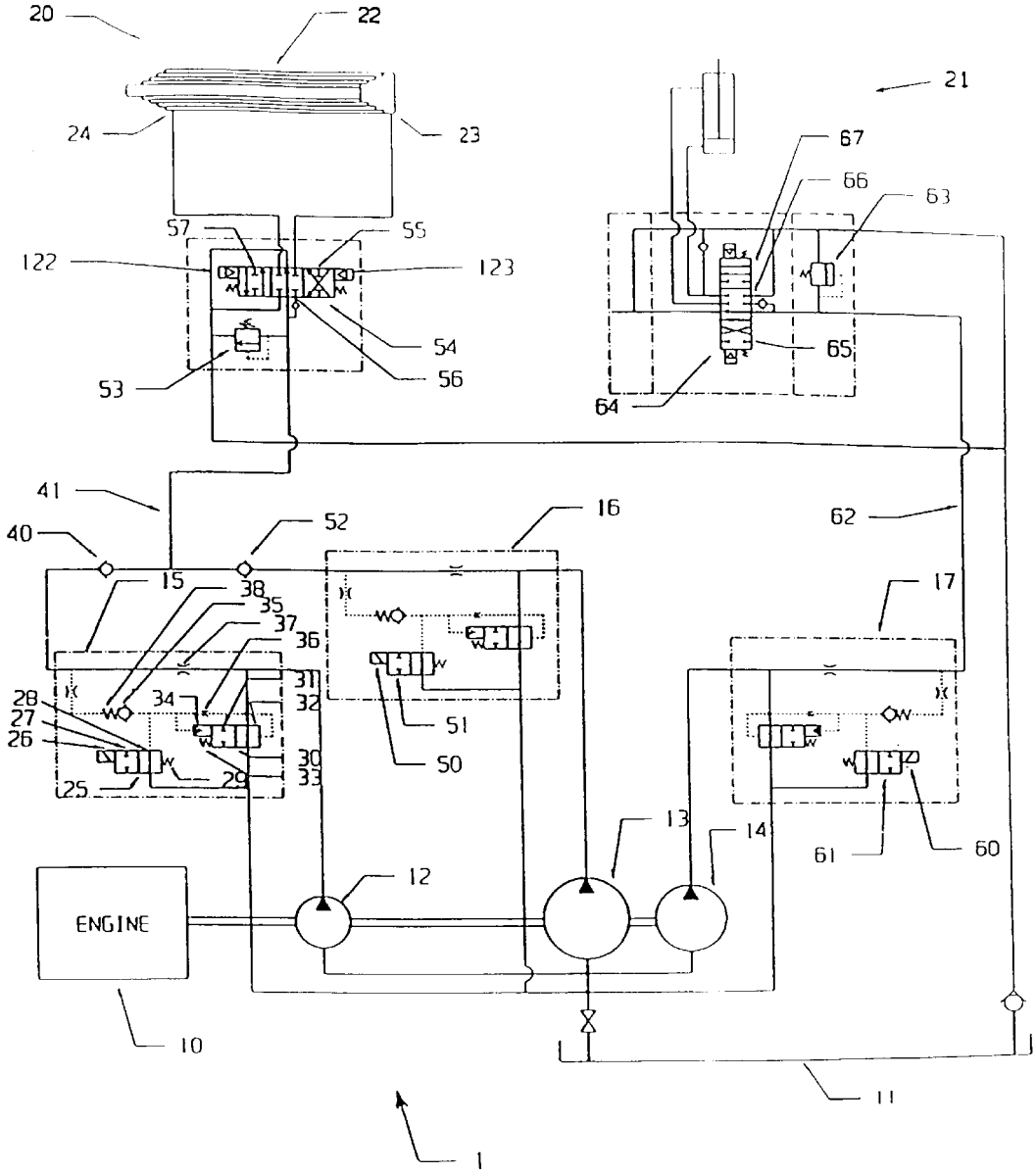
FIG. 1 is a hydraulic schematic of the preferred embodiment of the invention.

As herein described, when fluid flow is being dumped, a plurality of fixed displacement pumps 12, 13, and 14 are referred to as "off." When pressure is supplied to a hydraulic motor, the fixed displacement pumps 12–14 are referred to as "on".

Briefly, a control valve 15, 16 or 17 and a function valve 54 or 64 are controlled by signals external to a fluid system 1. They may also be controlled by signals within the fluid system. The signals are responsive to operating conditions of an engine 10 which drives the fixed displacement pumps 12–14, the mode of operation of the hydraulic motor in the form of a hydraulic cylinder 20 or 21, or the pressure in the fluid system 1. The signals external to the fluid system 1 are preferably electrical signals that shift the control valves 15–17 in a specific combination to achieve the desired fluid flows based on the operating speed of the engine 10, the hydraulic cylinder 20 or 21 being actuated, and/or the pressure being generated, for example, in a packer cylinder (such as 20) during packing of refuse. The present embodiment measures the speed of the engine and sends an electrical signal in response to the attainment of a specific speed. In addition, pressure switches associated with a packer panel are utilized to provide an electrical signal to control which pumps 12–14 are "on." The position of the hydraulic cylinder 20 or 21 is also sensed. Signals relating to engine speed, the mode of the hydraulic cylinder 20 or 21, and the packing pressure are used to determine whether one or more of the will be turned "on" or "off" by shifting the control valve 15, 16 or 17. In other words, the flow is selectively directed to either a reservoir 11 or a fluid-driven mechanism, i.e. hydraulic cylinder 20 or 21. This dumping is done at very low pressure so as not to generate much heat.

Prior arrangements relied on pressure and flow responsive means integral to the fluid system 1. In the present embodiment, with the exception of the pressure switches, the logic control of the fluid system 1 is external to the hydraulic lines. A transmission electronic control unit (not shown) is utilized to monitor engine speed and provide a corresponding signal.

Referring now to FIG. 1, the fluid system 1 includes the engine 10 operatively connected to the fixed displacement pumps 12–14. The fluid system 1 also includes the first control valve 15 operatively connected to pump 12, the second control valve 16 operatively connected to pump 13, and the third control valve 17 operatively connected to pump 14. The first control valve 15 and the second control valve 16 are operatively connected to a first hydraulic cylinder 20, having a base end 23 and a rod end 24, and the third control valve 17 is operatively connected to a second hydraulic cylinder 21. For example, the first hydraulic cylinder 20 may be a telescopic cylinder, such as a packing cylinder, and the second hydraulic cylinder 21 may be a conventional hydraulic cylinder, such as a lifting cylinder.

The first control valve 15 includes a first solenoid-operated valve 25 which has a first solenoid 26, a first valve position 27, a second valve position 28, and a first bias spring 29. The first control valve 15 also includes a pilot operated two-way valve 30 with an open fluid passageway 32 and a closed fluid passageway 31 and a second bias spring 33. A first check valve 35, a first small orifice 36, and a first control orifice 37 are also incorporated into the first control valve 15. In the fluid system 1, the control valve functions in like manner to turn "on" the fixed displacement pumps. By example, as the first pump 12 supplies fluid to the first control valve 15, fluid flows through the first control valve 15 and passes through the open fluid passageway 32 of the two-way valve 30 back to the fluid reservoir 11. Effectively, in this position the first pump 12 is "off." Fluid also flows through the first small orifice 36 and through the second valve position 28 in the first solenoid-operated valve 25 back to the fluid reservoir 11. The pressure drop across the first small orifice 36 is sufficiently high to hold the open fluid passageway 32 of the two-way valve 30 in position against the second bias spring 33. When the first solenoid 26 is energized, the first solenoid-operated valve 25 shifts such that the first valve position 27 is active and the fluid flow through the first solenoid-operated valve 25 is blocked. With the flow through the first solenoid-operated valve 25 blocked, there is no flow through the first small orifice 36 and therefore no longer a pressure drop across the first small orifice 36 and therefore no pressure to hold the open fluid passageway 32 of the two-way valve 30 in position against the second bias spring 33. The second bias spring 33 then shifts the two-way valve 30 to the closed fluid passageway 31, blocking the flow to the fluid reservoir 11. In this state, fluid from the first pump 12 has sufficient pressure to open a second check valve 40 and enter a first pressure line 41. Energizing the first solenoid 26 sends pressurized fluid from the first pump 12 to the first hydraulic cylinder 20. However, if the flow through the first control orifice 37 exceeds a predetermined level, the pressure drop across the first control orifice 37 will allow the first check valve 35 to open against a third bias spring 38. With the first check valve 35 open, flow is restored through the first small orifice 36 and the accompanying pressure drop across the first small orifice 36 causes the two-way valve 30 to shift back so that the open fluid passageway 32 is again active and a portion of the fluid supplied by the first pump 12 returns to the fluid reservoir 11 instead of being supplied to the first pressure line 41. The two-way valve 30 remains open with the open fluid passageway 32 active until the flow through the first control orifice 37 drops to a prescribed level and reduces the pressure drop so that the first check valve 35 is again forced closed by the third bias spring 38. When the first check valve 35 closes the flow through the first small orifice 36 stops and the pressure drop ceases thereby allowing the second bias spring 33 to shift to the closed fluid passageway 31 of the two-way valve 30 to the active position. The two-way valve 30 will modulate in this fashion to maintain the flow supplied by the first pump 12 at or below a desired level. The second control valve 16 and the third control valve 17 operate in an identical manner to the first control valve 15. The second control valve 16 includes a second solenoid 50 and a second solenoid-operated valve 51. The third control valve 17 includes a third solenoid 60 and a third solenoid-operated valve 61. Turning the pumps "on" and "off" can also be accomplished by other means well known to those skilled in the art, such as by using a "dry valve" that starves the pump of much of the hydraulic fluid.

Flow from the second pump 13 enters the first pressure line 41 through a third check valve 52 and the third pump 14 supplies a second pressure line 62. The first pump 12 and the second pump 13 supply fluid flow to the first hydraulic cylinder 20 while the third pump 14 supplies fluid flow to the second hydraulic cylinder 21. In the fluid system 1, the fixed displacement pumps may all have the same volume capacity or various volume capacities. In the preferred embodiment, the first pump 12 is smaller than the second pump 13, and the third pump 14 is sized to meet the needs of the second hydraulic cylinder 21. In the preferred embodiment, the first pump 12 has a capacity of 22 gallon a minute per pump, the second pump 13 has a capacity of 35 gallon a minute per pump, and the third pump 14 has a capacity of 31 gallon a minute per pump. The first pressure line 41 feeds a first function valve 54 that includes a third fluid passageway 55, a fourth fluid passageway 56, and a fifth fluid passageway 57. A first relief valve 53 may allow for fluid to return to the fluid reservoir 11 in the event that pressure levels in the first pressure line 41 exceed certain levels. When the first function valve 54 shifts so that fifth fluid passageway 57 is active, the first hydraulic cylinder 20 extends; when the third fluid passageway 55 is active the first hydraulic cylinder 20 retracts. With the fourth fluid passageway 56 active, the first function valve 54 is in the neutral position and fluid flow returns to the fluid reservoir 11.

The second pressure line 62 feeds a second function valve 64 that includes a sixth fluid passageway 65, a seventh fluid passageway 66, and a eighth fluid passageway 67. A second relief valve 63 may allow for fluid to return to the fluid reservoir 11 in the event that pressure levels in the second pressure line 62 exceed certain levels. When the second function valve 64 shifts so that the eighth fluid passageway 67 is active, the second hydraulic cylinder 21 retracts; when the sixth fluid passageway 65 is active, the second hydraulic cylinder 21 extends. With the seventh fluid passageway 66 active, the second function valve 64 is in the neutral position and fluid flow returns to the fluid reservoir 11. Control valves 15–17, and function valves 54 and 64 may be combined into a single valve block in any combination.

Figure 2:
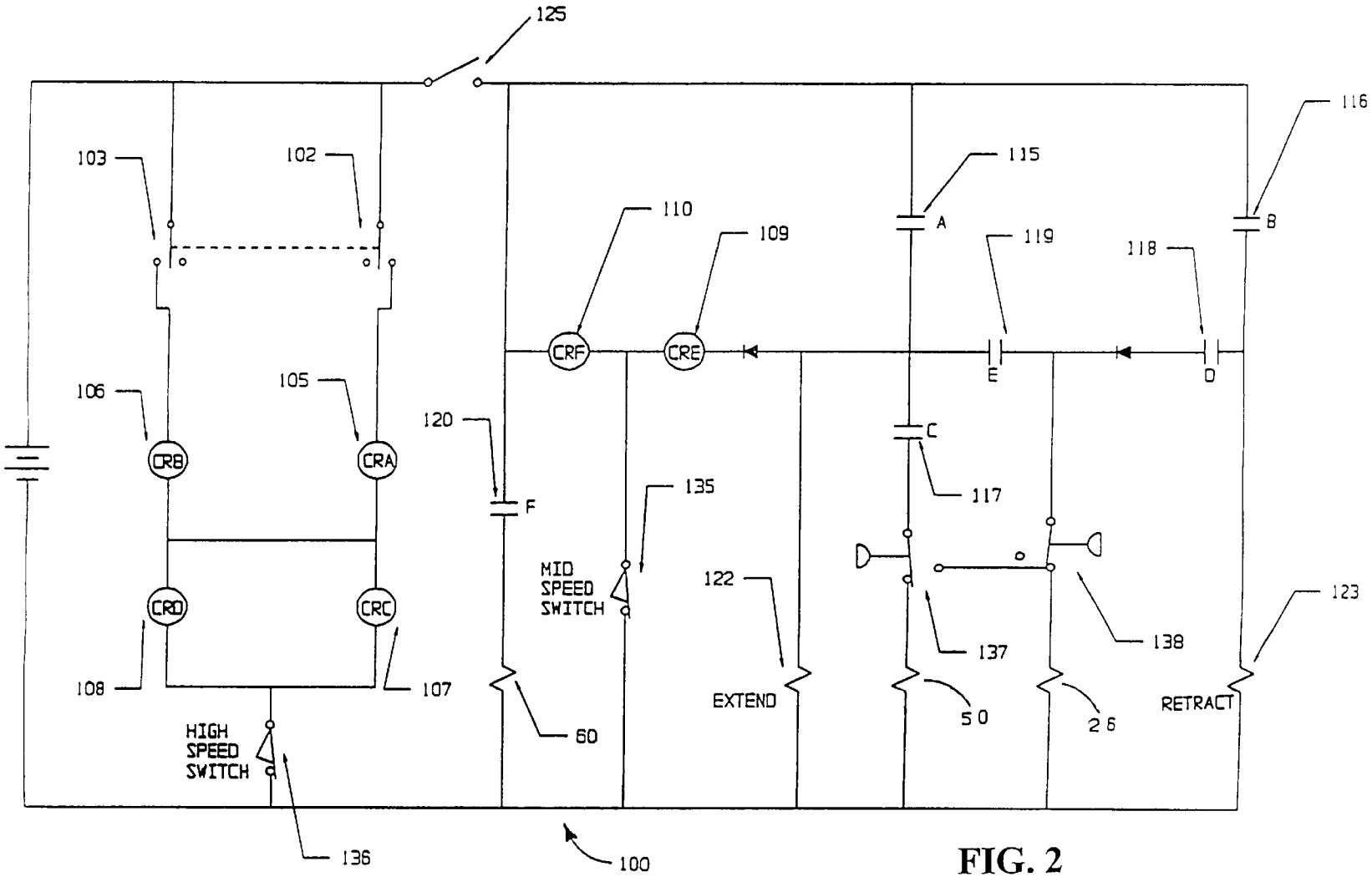
FIG. 2 is an electrical schematic of the preferred embodiment of the invention.

Referring now to FIG. 2, the fluid system 1 includes an electrical circuit 100 that accompanies and controls the fluid system 1. In the preferred embodiment the electrical circuit 100 includes an extend switch 102, a retract switch 103, a power switch 125, a first relay coil 105, a second relay coil 106, a third relay coil 107, a fourth relay coil 108, a fifth relay coil 109, a sixth relay coil 110, a high speed switch 136, a mid-speed switch 135, a normally closed low pressure switch 137, and a normally closed high pressure switch 138. The extend switch 102 and the retract switch 103 may be combined in the form of a single double pole, double throw switch to keep the operator from actuating both of them at the same time. Corresponding respectively to each relay coil are first relay contacts 115, second relay contacts 116, third relay contacts 117, fourth relay contacts 118, fifth relay contacts 119, and sixth relay contacts 120. All relay contacts are normally open contacts in the preferred embodiment. A fourth solenoid 122 shifts the first function valve 54 to extend the first hydraulic cylinder 20. A fifth solenoid 123 shifts the first function valve 54 to retract the first hydraulic cylinder 20. A first diode 130 and a second diode 131 are included in the electrical circuit 100 to maintain proper function of the preferred embodiment. Energizing the first solenoid 26 effectively turns "on" the first pump 12, whereas energizing the second solenoid 50 effectively turns "on" the second pump 13. Energizing the third solenoid 60 effectively turn "on" the third pump 14. When the normally closed high pressure switch 138 is activated, the first solenoid 26 is de-energized effectively turning "off" the first pump 12. When the normally closed low pressure switch 137 is actuated, the second solenoid 50 is de-energized shutting "off" the second pump 13. The normally closed low pressure switch 137 also causes the first solenoid 26 to be energized even if the normally closed high pressure switch 138 is activated.

The preferred embodiment of the invention has low, middle, and high-speed conditions, as well as low, medium and high pressure conditions. It is to be understood that the electrical circuit 100 can be simplified by reducing the number of inputs or that better matching of the output horsepower to the available horsepower could be accomplished by increasing the number of pressure and speed inputs. Any number of operation modes can be created by the addition of inputs and the addition of more pumps and the appropriate modifications to the electrical circuit 100.

TABLE 1

| | A | B | C | D | E | F | G | H | I |
|---|---|---|---|---|---|---|---|---|---|
| Condition: | | | | | | | | | |
| Under 1200 RPM | X | X | 0 | 0 | 0 | X | X | 0 | 0 |
| 1200–1800 RPM | 0 | 0 | X | X | 0 | 0 | 0 | X | X |
| Over 1800 RPM | 0 | 0 | 0 | 0 | X | 0 | 0 | 0 | 0 |
| Extend on | X | 0 | X | 0 | 0 | X | X | X | X |
| Retract on | 0 | X | 0 | X | 0 | 0 | 0 | 0 | 0 |
| Under 1500 psi | X | X | X | X | 0 | 0 | 0 | 0 | 0 |
| 1500–2300 psi | 0 | 0 | 0 | 0 | 0 | X | 0 | X | 0 |
| Over 2300 psi | 0 | 0 | 0 | 0 | 0 | 0 | X | 0 | X |
| Pump Conditions: | | | | | | | | | |
| Pump 12 | X | X | 0 | X | 0 | 0 | X | 0 | X |
| Pump 13 | X | 0 | X | 0 | 0 | X | 0 | X | 0 |
| Pump 14 | X | X | 0 | 0 | 0 | X | X | 0 | 0 |

Table 1 shows nine of the conditions of the present invention and the corresponding condition of the first pump 12, the second pump 13, and the third pump 14. An "X" in the chart means the function is active or that the pump is "on." An "O" in the chart means that the function is not active or that the pump is "off." The following describes the electrical circuit 100 in condition A of Table 1. In this condition, the first pump 12 and the second pump 13 pressurize the first pressure line 41 and the third pump 14 pressurizes the second pressure line 62. The pressurization of the first pressure line 41 allows the first hydraulic cylinder 20, such as a telescopic cylinder, to be actuated. The telescopic cylinder may be used to push a packer panel to compact refuse into a refuse body. The pressurization of the second pressure line 62 allows the second hydraulic cylinder 21, such as an automated lift, to be actuated.

Closing the power switch 125 activates the electrical circuit 100 of the preferred embodiment. With the system active and the engine 10 in the low speed range, the mid-speed switch 135 is closed, the sixth relay 110 is energized and the sixth relay contacts 120 close to energize the third solenoid 60 in the third control valve 17 turning "on" the third pump 14 to the second pressure line 62. With pressurized flow available at the second pressure line 62, the second hydraulic cylinder 21 can be operated. When the extend switch 102 is closed with the engine 10 still at low speed, the first relay coil 105, the third relay coil 107, and the fourth relay coil 108 are energized and the first relay contacts 115, the third relay contacts 117, and the fourth relay contacts 118 are closed. Closing the first relay contacts 115 also energizes the fifth relay coil 109 and closes the fifth relay contacts 119. With the first relay contacts 115 and the third relay contacts 117 closed, the second solenoid 50 becomes energized and turns "on" the second pump 13. When the first relay contacts 115 and the fifth relay contacts 119 are closed, electrical power reaches the first solenoid 26 which turns "on" the first pump 12. Closing the first relay contacts 115 provides power to the fourth solenoid 122, which shifts the first function valve 54 so that the fifth fluid passageway 57 is active and the first pressure line 41 is directed to the base end 23 of the first hydraulic cylinder 20 and the first hydraulic cylinder 20 extends. For example, fluid would enter the fifth fluid passageway 57 go through the first pressure line 41 enter the base end of a telescopic cylinder, extending the packer panel. Flow from both the first pump 12 and the second pump 13 are combined in the first pressure line 41 to maximize fluid flow while the engine 10 is at low speed. At low speed the fixed displacement pumps deliver minimal flow and it is advantageous to combine the flows of all pumps available.

Condition B of Table 1 allows for the retraction of the first hydraulic cylinder 20. The following describes Condition B after extending the first hydraulic cylinder 20 as provided in Condition A. The retract switch 103 is closed and the extend switch 102 opens. The sixth coil relay 110 is still energized at low engine speed and the sixth relay contacts 120 are closed to provide power to the third solenoid 60 turning "on" the third pump 14 so that the second hydraulic cylinder 21 can be used. Closing the retract switch 103 energizes the second relay coil 106, the third relay coil 107, and the fourth relay coil 108 which closes the second relay contacts 116, the third relay contacts 117, and the fourth relay contacts 118. With the second relay contacts 116 and the fourth relay contacts 118 closed, the first solenoid 26 is energized turning "on" the first pump 12 to pressurize the first pressure line 41. The second pump 13 is not "on" in this mode of operation as the electrical circuit 100 does not energize the second solenoid 50. When the second relay contacts 116 are closed, the fifth solenoid 123 is energized and the first function valve 54 shifts the third fluid passageway 55 to the active position such that from the first pressure line 41 is directed to the rod end 24 of the first hydraulic cylinder 20 and the first hydraulic cylinder 20 retracts. For example, fluid would enter the third fluid passageway 55 go through the first pressure line 41 enter the rod end 24 of a telescopic cylinder, retracting the packer panel. Only flow from the first pump 12 is used to retract the first hydraulic cylinder 20. For example if the first hydraulic cylinder 20 were a telescopic cylinder, the volume needed at the rod end 24 of the telescopic cylinder is much smaller than that at the base end 23 to achieve an adequate rate of travel, thus only a single small volume pump is required.

Condition C of Table 1 is when the speed of the engine 10 increases to a middle speed, such as over 1200 RPM. The mid-speed switch 135 opens in response to a signal from the transmission electronic control unit (not shown) that directly monitors engine speed, and the sixth relay coil 110 is de-energized. When the sixth relay coil 110 is de-energized, the sixth relay contacts 120 open so that power is no longer supplied to the third solenoid 60, turning "off" the third pump 14. When the third pump 14 is turned "off," the second hydraulic cylinder 21 is inactive. This prevents the second hydraulic cylinder 21 from inadvertently operating when going above a low speed. In alternate embodiments of the invention, various functions or series of functions could be turned on or off at certain speed ranges as desired. With the engine 10 at middle speed, the extend switch 102 is closed and the first relay coil 105, the third relay coil 107, and the fourth relay coil 108 are energized to close the first relay contacts 115, the third relay contacts 117, and the fourth relay contacts 118. With the first relay contacts 115 and the third relay contacts 117 closed, power is available to the second solenoid 50 which turns "on" the second pump 13 to pressurize the first pressure line 41. In this mode power is not supplied to the first solenoid 26 and, therefore, the first pump 12 remains inactive. The fourth solenoid 122 is also energized and shifts the first function valve 54 so that the fifth fluid passageway 57 is active and fluid flows to the first hydraulic cylinder 20 causing it to extend.

Condition D of Table 1 is retracting the first hydraulic cylinder 20 at mid-speed. The sixth relay coil 110 is not energized because the mid-speed switch 135 is open. Therefore the sixth relay contacts 120 are open and the third solenoid 60 is not energized so the third pump 14 remains "off." Closing the retract switch 103 energizes the second relay coil 106, the third relay coil 107, and the fourth relay coil 108 which closes the second relay contacts 116, the third relay contacts 117, and the fourth relay contacts 118. With the second relay contacts 116 and the fourth relay contacts 118 closed, the first solenoid 26 is energized turning "on" the first pump 12 to pressurize the first pressure line 41. The second pump 13 is not "on" in this mode of operation as the electrical circuit 100 does not energize the second solenoid 50. Closed second relay contacts 116 energize the fifth solenoid 123 and the first function valve 54 shifts the third fluid passageway 55 to the active position such that flow from the first pressure line 41 is directed to the rod end 24 of the first hydraulic cylinder 20 and the hydraulic cylinder 20 retracts.

Condition E is the high speed condition. In this condition both mid-speed switch 135 and high-speed switch 136 are open. In this condition the first relay coil 105, the second relay coil 106, the third relay coil 107, the fourth relay coil 108, the fifth relay coil 109, and the sixth relay coil 110 are not energized and their corresponding relay contacts are open, therefore the first pump 12, the second pump 13, and the third pump 14 are "off." This is important for going down the road as the valving and piping for handling the flows at low and medium speeds cannot handle the high flows generated at high speed.

Condition F of Table 1 is similar to Condition A except that the load pressure is now over 1500 psi. In Condition A, the first solenoid 26, the second solenoid 50, and third solenoid 60 were all actuated turning "on" their respective pumps. For Condition F, the normally closed low pressure switch 137 opens and de-energizes the first solenoid 26, turning "off" the first pump 12. Because the required power is a function of pressure and flow, in this condition and as the pressure is increased, the flow is decreased to maintain a workable output power, without adding heat to the system by sending fluid to the fluid reservoir at high pressure.

Condition G of Table 1 is when the load pressure in the first hydraulic function is over 2300 psi. The power switch 125 is closed and the mid-speed switch 135 is closed. This powers the sixth relay 110 which closes the sixth relay contacts 120 and energizes the third solenoid 60 which turns "on" the third pump 14. When the operator actuates the extend switch 102, the first relay coil 105, the third relay coil 107, the fourth relay coil 108, and the fifth relay coil 109 are energized closing the first relay contacts 115, the third relay contacts 117, the fourth relay contacts 118, and the fifth relay contacts 119. The fourth solenoid 122 is energized as current flows through the first relay contacts 115. The normally closed low pressure switch 137 and the normally closed high pressure switch 138 are both in the actuated position. Current flows through the third relay contacts 117 to the open contact of the normally closed low pressure switch 137 to the first solenoid 26, which turns "on" the first pump 12. With the normally closed low pressure switch 137 actuated the second solenoid 50 is not energized and the second pump 13 remains "off."

Conditions H and I are the same as Conditions F and G respectively, except that the speed is in the midrange. This opens the mid-speed switch 135 de-energizing the third solenoid 60 turning "off" the third pump 14.

It is understood that hydraulic and electrical circuits can be configured in numerous ways and that the logic of the preferred embodiment can take many specific forms without departing from the scope and general principles of the present invention. The scope of the invention should be derived from the following claims rather than the foregoing description.

I claim:

1. A fluid system including:

a hydraulic motor;

a fluid reservoir;

a plurality of fixed displacement pumps;

drive means operatively connected to the fixed displacement pumps for driving the same;

a control valve for selectively directing a flow of fluid to either the reservoir or the hydraulic motor;

a function valve operatively connected to the control valve;

a control system having means for determining an external condition, including a rotational speed measuring device for measuring the rotational speed of the drive means, wherein the rotational speed measuring device generates an electrical signal, the control system further including an electrical circuit that receives the electrical signal from the rotational speed measuring device and communicates with the control valve and the function valve;

means responsive to the signal for switching the control valve; and said fluid system being adapted for use on a refuse truck;

wherein the control valve and the function valve are combined into a single valve block.

2. A fluid system including:

a hydraulic motor;

a fluid reservoir;

a plurality of fixed displacement pumps;

drive means operatively connected to the fixed displacement pumps for driving the same;

a control valve for selectively directing a flow of fluid to either the reservoir or the hydraulic motor, the control valve including a two-way valve having a plurality of fluid passageways that selectively allow fluid to flow from the fixed displacement pumps to the fluid reservoir, the control valve further including a first solenoid-operated valve having a solenoid and a plurality of fluid passageways, wherein the solenoid communicates with the electrical circuit to select one of the fluid passageways of the first solenoid-operated valve;

a function valve operatively connected to the control valve;

a control system having means for determining an external condition, the control system including a rotational speed measuring device for measuring the rotational speed of the drive means, the rotational speed measuring device generating an external electrical signal, the control system further including an electrical circuit that receives the electrical signal from the rotational speed measuring device and communicates with the control valve and the function valve;

means responsive to the signal for switching the control valve; and said fluid system being adapted for use on a refuse truck.

3. A fluid system including:

a hydraulic motor;

a fluid reservoir;

a plurality of fixed displacement pumps;

drive means operatively connected to the fixed displacement pumps for driving the same;

a control valve for selectively directing a flow of fluid to either the reservoir or the hydraulic motor;

a function valve operatively connected to the control valve; the function valve including a valve having a solenoid and a plurality of fluid passageways;

a control system having means for determining an external condition, the control system including a rotational speed measuring device for measuring the rotational speed of the drive means, the rotational speed measuring device generating an external electrical signal, the control system further including an electrical circuit that receives the electrical signal from the rotational speed measuring device and communicates with the control valve and the function valve;

means responsive to the signal for switching the control valve; and said fluid system being stained for use on a refuse truck;

wherein the solenoid communicates with the electrical circuit to select one of the fluid passageways of the function valve.

4. A fluid system including:

a hydraulic motor;

a fluid reservoir;

a plurality of fixed displacement pumps;

drive means operatively connected to the faxed displacement pumps for driving the same;

a control valve for selectively directing a flow of fluid to either the reservoir or the hydraulic motor;

a function valve operatively connected to the control valve;

a control system having means for determining an external condition the control system including a rotational speed measuring device for measuring the rotational speed of the drive means, the rotational speed measuring device generates an external electrical signal, the control system further including an electrical circuit that receives the electrical signal from the rotational speed measuring device and communicates with the control valve and the function valve wherein the electrical circuit includes:

a retract and extend switch to select the mode of the hydraulic motor; wherein the control system means responsive to the signal for switching the control valve includes a switch; and said fluid system being adapted for use on a refuse truck.

5. A fluid system comprising:

a first fixed displacement pump, a second fixed displacement pump that has a larger displacement than the first fixed displacement pump, and a third displacement pump, wherein the first fixed displacement pump, the second fixed displacement pump and the third fixed displacement pump are selectively turned "on" and "off" in response to a signal means, wherein said signal means is external to the fluid system;

a drive means operatively connected to the first fixed displacement pump, the second fixed displacement pump, and the third fixed displacement pump;

a first control valve operatively connected to the first fixed displacement pump and the second fixed displacement pump;

a second control valve operatively connected to the third fixed displacement pump;

a first function valve operatively connected to the first control valve;

a second function valve operatively connected to the second control valve;

a first hydraulic motor operatively connected to the first function valve;

a second hydraulic motor operatively connected to the second function valve; and an electrical circuit that receives the signal means and communicates with the first control valve, the second control valve, the first function valve, and the second function valve; said fluid system being adapted for use on a refuse truck.

6. The fluid system of claim 5 wherein said signal means is external and internal to the fluid system.

7. A fluid system including:

a hydraulic motor;

a fluid reservoir;

a plurality of fixed displacement pumps;

drive means operatively connected to the fixed displacement pumps for driving the same;

a control valve for selectively directing a flow of fluid to either the reservoir or the hydraulic motor;

a control system having means for determining an external condition and an internal condition, generating a corresponding signal for each condition, and means responsive to the signals for switching the control valve;

a pressure monitoring device for monitoring the pressure in the fluid system, wherein the pressure monitoring device generates the internal signal; and said fluid system being adapted for use on a refuse truck.

8. The fluid system of claim 7 wherein the external signal and the internal signal are electrical.

9. The fluid system of claim 8 further comprising:

a function valve operatively connected to the control valve; wherein the control system includes an electrical circuit that receives the electrical signals from the rotational speed measuring device and the pressure monitoring device and communicates with the control valve and the function valve.

10. It The fluid system of claim 9 wherein the control valve includes:

a two-way valve having a plurality of fluid passageways that selectively allow fluid to flow from the fixed displacement pumps to the fluid reservoir; and a first solenoid-operated valve having a solenoid and a plurality of fluid passageways, wherein the solenoid communicates with the electrical circuit to select one of the fluid passageways of the first solenoid-operated valve.

11. The fluid system of claim 9 wherein the function valve includes:

a valve having a solenoid and a plurality of fluid passageways, wherein the solenoid communicates with the electrical circuit to select one of the fluid passageways of the function valve.

12. The fluid system of claim 9 wherein the fixed displacement pumps are comprised of fixed displacement pumps of different flow output.

13. The fluid system of claim 9 wherein the electrical circuit includes:

a retract and extend switch to select the mode of the hydraulic motor; wherein the control system means responsive to the signals for switching the control valve includes a switch, wherein the switch connections change based on the means.

* * * * *

UNITED STATES PATENT AND TRADEMARK OFFICE

CERTIFICATE OF CORRECTION

PATENT NO. : 6,752,600 B2
DATED : June 22, 2004
INVENTOR(S) : Worthington

It is certified that error appears in the above-identified patent and that said Letters Patent is hereby corrected as shown below:

Column 10,
Line 59, please change the word “stained” to -- adapted --.

Column 11,
Line 1, please change the word “faxed” to -- fixed --.

Signed and Sealed this

Fifth Day of October, 2004

JON W. DUDAS
*Director of the United States Patent and Trademark Office*